US007604521B2

(12) United States Patent
Ferez

(10) Patent No.: US 7,604,521 B2
(45) Date of Patent: Oct. 20, 2009

(54) AQUATIC EXERCISE ROWING MACHINE

(76) Inventor: Marcio Ferez, 777 E. 25th St., Suite 206, Hialeah, FL (US) 33013

( * ) Notice: Subject to any disclaimer, the term of this patent is extended or adjusted under 35 U.S.C. 154(b) by 0 days.

(21) Appl. No.: 11/738,015

(22) Filed: Apr. 20, 2007

(65) Prior Publication Data

US 2008/0305696 A1 Dec. 11, 2008

(51) Int. Cl.
*B63H 16/08* (2006.01)
*B63H 16/18* (2006.01)
*B63H 5/02* (2006.01)

(52) U.S. Cl. ..... 440/21; 440/32; 440/90

(58) Field of Classification Search ..... 440/21, 440/26–32, 90, 25, 12.66, 12.68; 280/240, 280/246–248, 256, 257, 242.1, 244, 253
See application file for complete search history.

(56) References Cited

U.S. PATENT DOCUMENTS 557,647 A * 4/1896 Boulter ..... 440/30
1,165,375 A * 12/1915 Abramski ..... 440/25
1,551,360 A * 8/1925 Baker ..... 440/30
1,705,402 A * 3/1929 Hatzi ..... 440/30
1,758,957 A * 5/1930 McKay ..... 280/257
1,793,528 A * 2/1931 Szabo ..... 440/32
2,357,084 A * 8/1944 Cleofe ..... 416/235
3,449,855 A * 6/1969 Hassel ..... 43/56
3,680,522 A * 8/1972 Clark et al. ..... 440/32
5,492,349 A 2/1996 Ferez ..... 280/248
6,083,062 A * 7/2000 Treloar et al. ..... 440/30
6,691,633 B1 * 2/2004 Metzger et al. ..... 114/61.1

* cited by examiner

*Primary Examiner*—Ajay Vasudeva
(74) *Attorney, Agent, or Firm*—Sanchelima & Associates, P.A.

(57) ABSTRACT

A floating exercise rowing machine with two elongated floating assemblies that are kept at a parallel and spaced apart relationship with respect to each other by two transversal frame assemblies and a longitudinally extending frame assembly. The frame assemblies support a seat assembly mounted at the middle of the floating exercise machine. A propulsion mechanism that includes a bar that is pivotally mounted to the frame assembly with a coaxially extending actuating end that moves reciprocally between two extreme positions to cause, through linkage arms, the rotation of sprockets that in turn impart a rotational movement to a transversal axle that supports two paddle wheels at the ends. A steering mechanism permits a user to steer the floating machine with his/her hands.

9 Claims, 8 Drawing Sheets

AQUATIC EXERCISE ROWING MACHINE

BACKGROUND OF THE INVENTION

1. Field of the Invention

The present invention relates to an aquatic exercise rowing machine, and more particularly, to such a machine that is used in a body of water.

2. Description of the Related Art

Several designs for exercise machines have been designed in the past. None of them, however, includes a floating rowing machine that utilizes paddle wheels to propel itself by the user.

Applicant believes that the closest reference corresponds to U.S. Pat. No. 5,492,349 issued to the inventor herein for a rowing locomotion device issued in 1996. Ferez's prior patented apparatus includes a similar propulsion mechanism for rowing. However, it differs from the present invention because it cannot be used in a body of water since it does not float. The mechanism is also not suitable for propelling paddle wheels unless the novel improvements claimed herein are incorporated. A user also steers the floating machine with his/her hands with a steering mechanism.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an exercise rowing machine that permits a user to move over a body of water.

It is another object of this invention to provide a machine that allows a user to exercise with movements similar to those required for a rowing boat without requiring the skills to steer the latter.

It is still another object of the present invention to provide a floating rowing machine that permits a user to steer it over a body of water using his/her hands.

Still another object of the invention is a device that will provide fun and pleasure for a sustained physical exercise program regardless of the user's age or skills.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 6 is a partial top view of one of the paddle members at its uppermost position showing its angular relationship with respect to axle 64.

DETAILED DESCRIPTION OF THE PREFERRED EMBODIMENT

Figure 1:
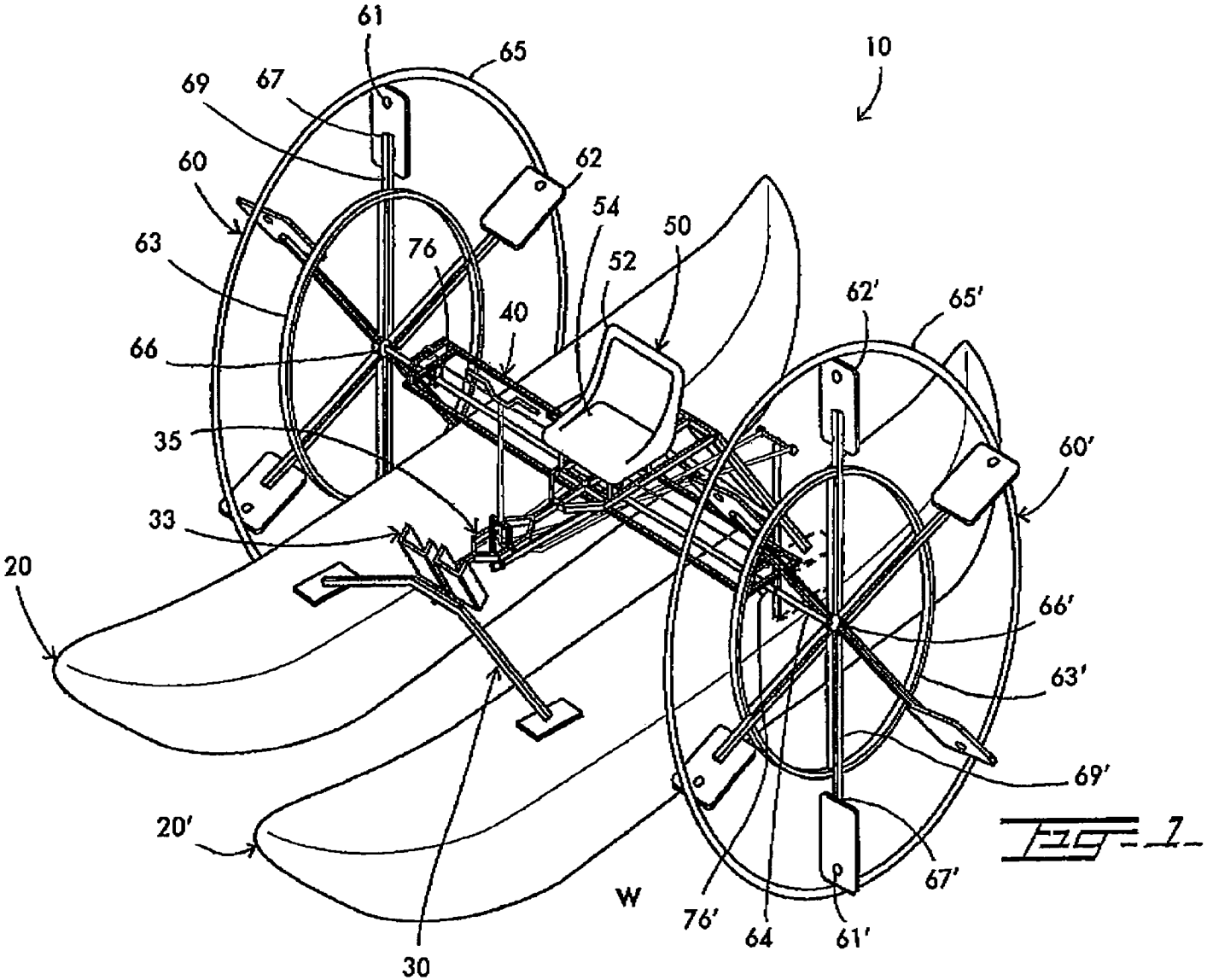
FIG. 1 represents an isometric view of one of the preferred embodiments for the present invention.

Referring now to the drawings, where the present invention is generally referred to with numeral 10, it can be observed that it basically includes two floating assemblies 20 and 20' kept at a spaced apart and parallel relationship with respect to each other by frame assemblies 30 and 40. Longitudinal frame assembly 35 extends from, and is mounted to, assemblies 30 and 40. Seat assembly 50 is supported by assembly 40, positioned substantially at the middle of machine 10. Paddle wheel assembly 60 includes paddle blade members 62 and 62' rigidly mounted to shafts 69 and 69' that in turn are mounted to hub members 66 and 66' that receive the ends of axle 64. Propulsion mechanism 70 is mounted on assembly 30, the former being cooperatively adapted to transmit a rotational movement to axle 64. Steering assembly 90 is mounted to frame assemblies 30 and 40. Assembly 90 is connected to tiller assembly 80 to the rear end of machine 10. The foregoing assemblies and members cooperate to permit a seated user to propel and steer machine 10 over a body of water, W.

Floating assemblies 20 and 20' have, in one of the preferred embodiments, an elongated shape and together define the front and rear ends of floating machine 10. Assemblies 20 and 20' can be made of metal, rubber or plastic with nylon fiber cover, fiberglass, or equivalent material to form a hollow buoyant body. Other solid materials such as foam, cork, and other equivalent material can also be used provided they are sufficiently buoyant.

Frame assemblies 30 and 40 are rigid and each have two ends. Assemblies 30 and 40 are transversally positioned between floating assemblies 20 and 20', to which their respective ends are mounted. In one of the preferred embodiments assemblies 30 and 40 are aluminum bars of sufficient strength, yet relatively low weight, to support the weight of the other assemblies and members they support.

Feet rest assembly 33 is mounted to assembly 30 to ergonomically cooperate and support a user's feet. Many variations can be used including those with adjustable mechanisms for varying the distance to seat assembly 50.

Seat assembly 50 includes seat frame 52 that is supported by assembly 40. Seat frame 52 can have a variety of designs. Preferably, a seat cushion 54 is also provided for the comfort of the user.

Paddle assemblies 60 and 60' include axle 64 that is rigidly mounted to hub members 66 and 66'. Sprocket member 68 is rigidly mounted to axle 64 at a predetermined location between bearing members 76 and 76'. Paddle wheels 63 and 63' are mounted to shafts 69 and 69' which in turn extend radially from members 66 and 66', that in turn receive the ends of axle 64. Paddle members 62 and 62' are slanted an angle A of approximately between 30 and 50 degrees with respect to axle 64, as seen in FIG. 6. Placing members 62 and 62' at an angle is intended to reduce the resistance of the water being displaced. Paddle members 62 and 62' include through openings 61 and 61', respectively, also intended to reduce the resistance of the water. Also, in one of the preferred embodiments weights 67 and 67' have been mounted to paddle wheels 63 and 63' for balancing purposes. Weight 67 is mounted, in the preferred embodiment, at the base of one of the paddle members 62. Weight 67' is mounted to the base of a paddle 62' in the opposite wheel 63' and at 180 degrees displacement with respect to weight 67. The dimensions of paddles 62 and 62', as well as through openings 61 and 61' can vary depending on the user's preferences and application.

Rim assembly 65 (and 65') connects paddle members 62 (and 62') to provide a structure that permits a user to pull apparatus 10 from the water and transport it on a solid surface. While not designed to carry considerable weight, rim assembly 65 and 65' facilitates moving machine 10 over relatively small distances.

Figure 11:
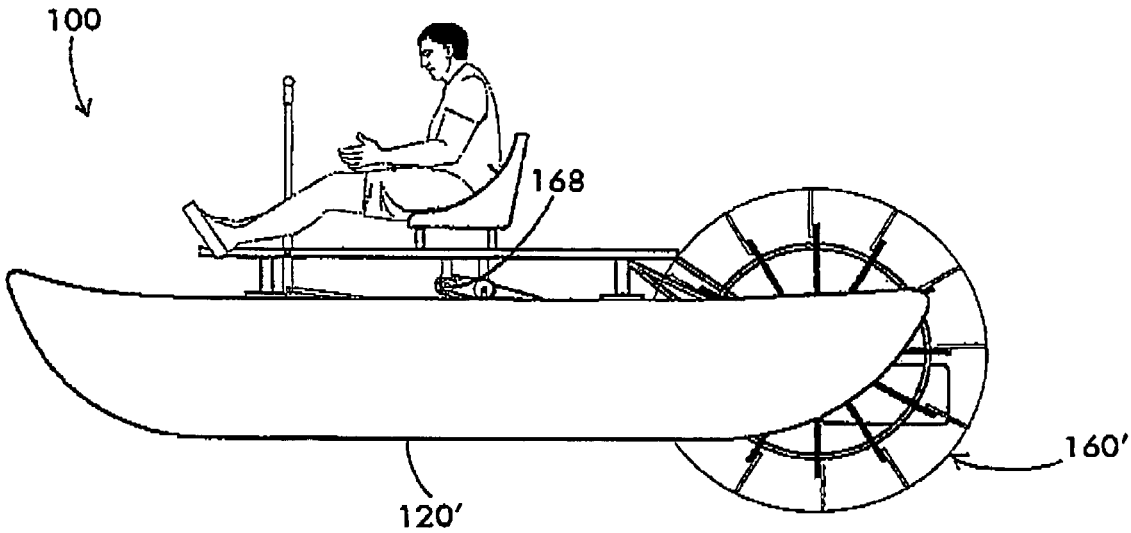
FIG. 11 is an elevational view of an alternate embodiment.
Figure 12:
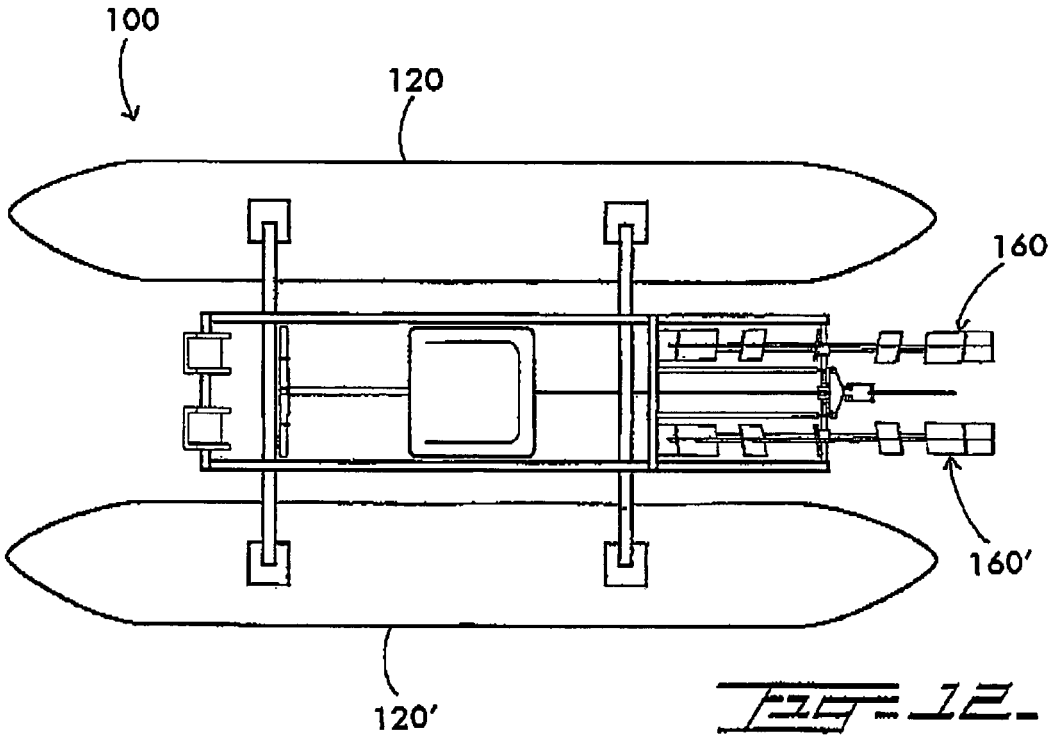
FIG. 12 is a plan view of the alternate embodiment shown in FIG. 11.

Paddle assemblies 160 and 160' are mounted between floating assemblies 120 and 120', at the rear in alternate embodiment 100. The advantage of this embodiment is a more volumetrically efficient apparatus, as shown in FIGS. 11 and 12.

Figure 4:
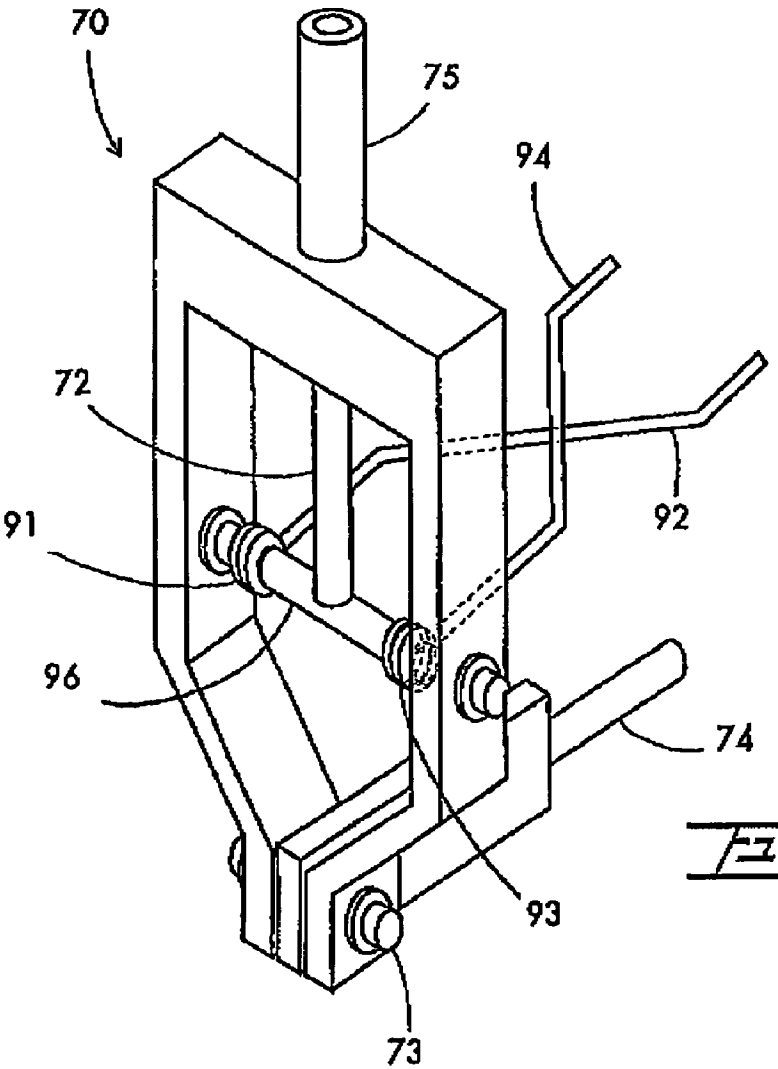
FIG. 4 is an isometric view of a portion of propulsion mechanism 70 in the present invention.
Figure 5:
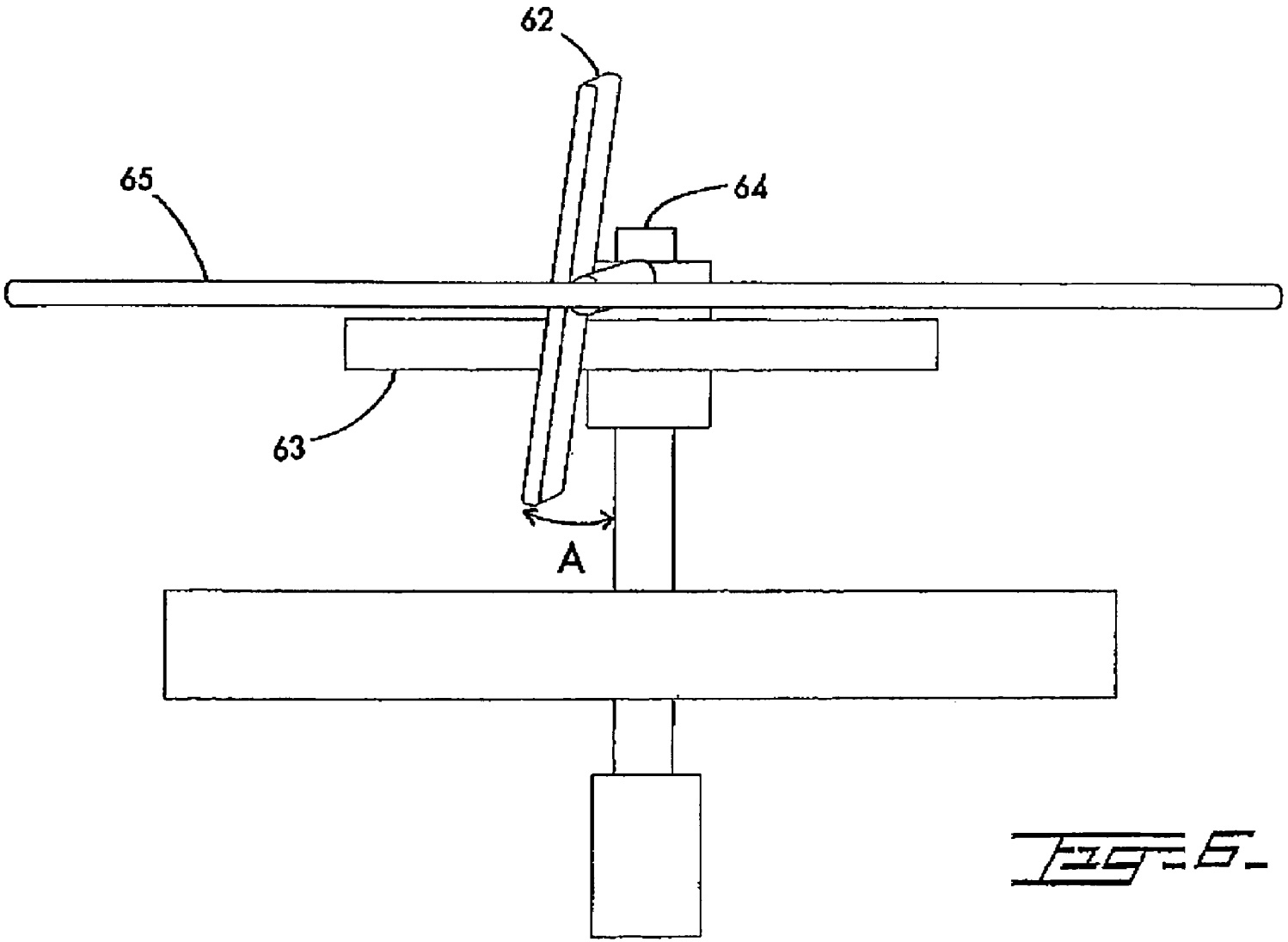

Propulsion mechanism 70 includes handle 71 perpendicularly mounted to one end of bar 72. The other end of bar 72 is rigidly and perpendicularly mounted to steering horizontal rod 96, which is allowed to rotate. Propulsion tube 75 coaxially houses most of bar 72. One of the preferred embodiments for tube 75 coaxially houses most of bar 72. One of the preferred embodiments for tube 75 includes a ring portion 36 through which bar 72 is rotably mounted Actuating frame assembly 78, as best seen in FIGS. 1 and 4, is mounted to the lowermost end of tube 75. Assembly 78 pivots about fulcrum point 77 of frame assembly 35. The distal end of assembly 78 includes pin 73 to which one end of linkage bar 74 is pivotally mounted at one end and the other end being pivotally mounted to linkage member 85 at a point off-centered of sprocket member 88. Member 85 is mounted to the center of sprocket member 88. Pin 73 is located at a relatively short distance from fulcrum point 77 with respect to the distance of handle 71 to point 77.

Figures 7, 8:
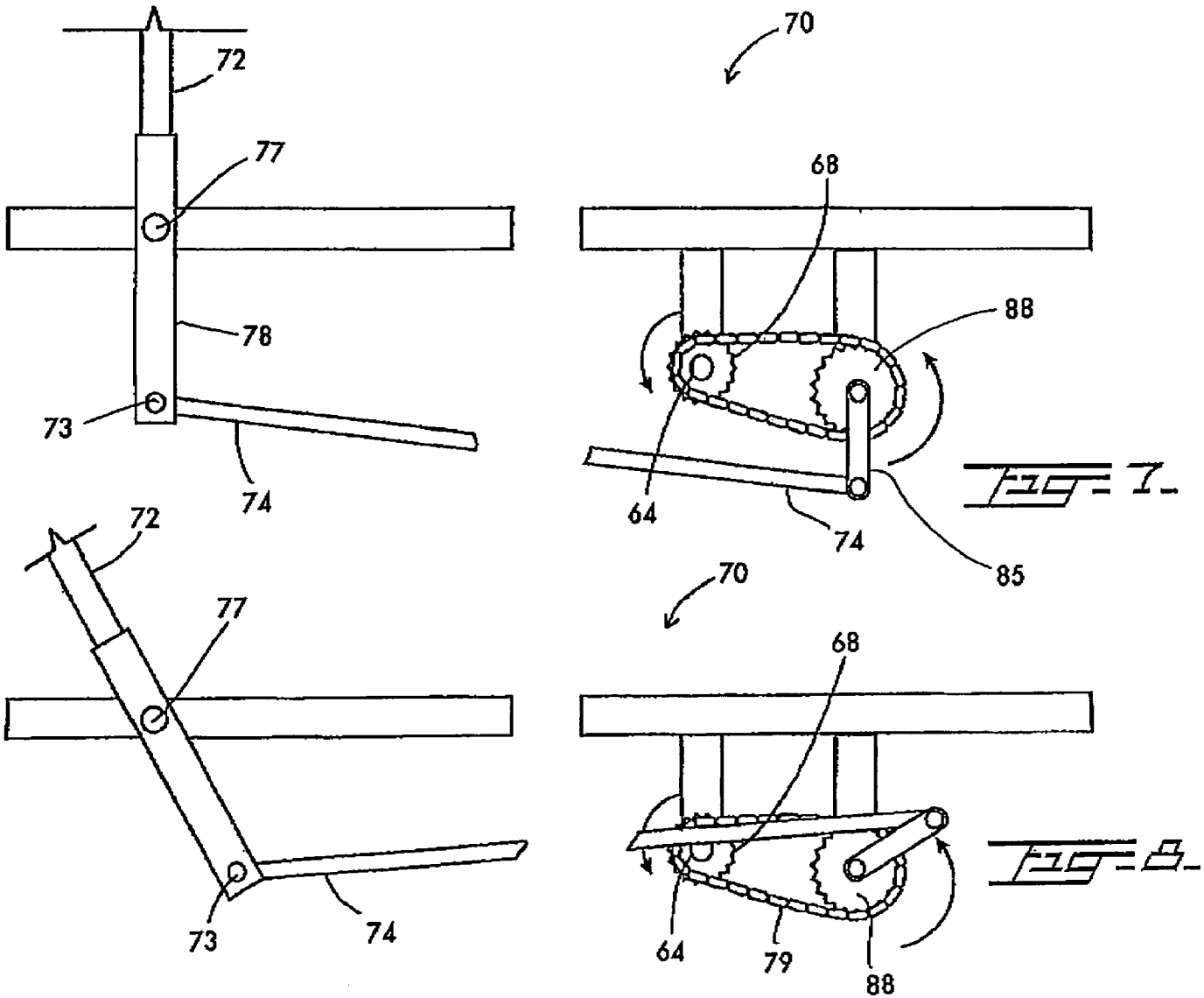
FIG. 7 is a broken side elevational view of the propulsion mechanism with bar 72 in the perpendicular position.
FIG. 8 is a similar representation of the mechanism shown in FIG. 7 with bar 72 at an angle.

As best seen in FIGS. 7 and 8, chain 79 is trained over sprocket members 68 and 88 to transmit the rotational movement of the latter to the former.

Figure 3:
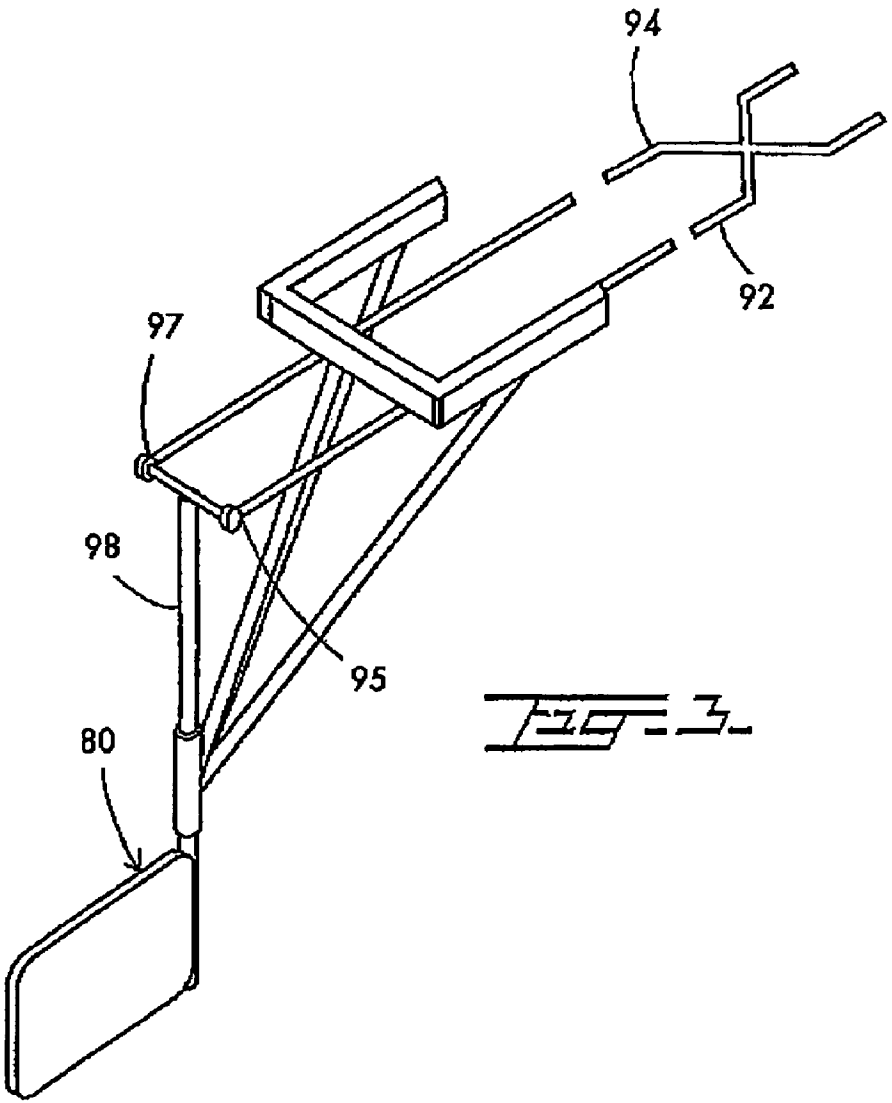
FIG. 3 illustrates an isometric view of tiller assembly 80 in the present invention.
Figure 2:
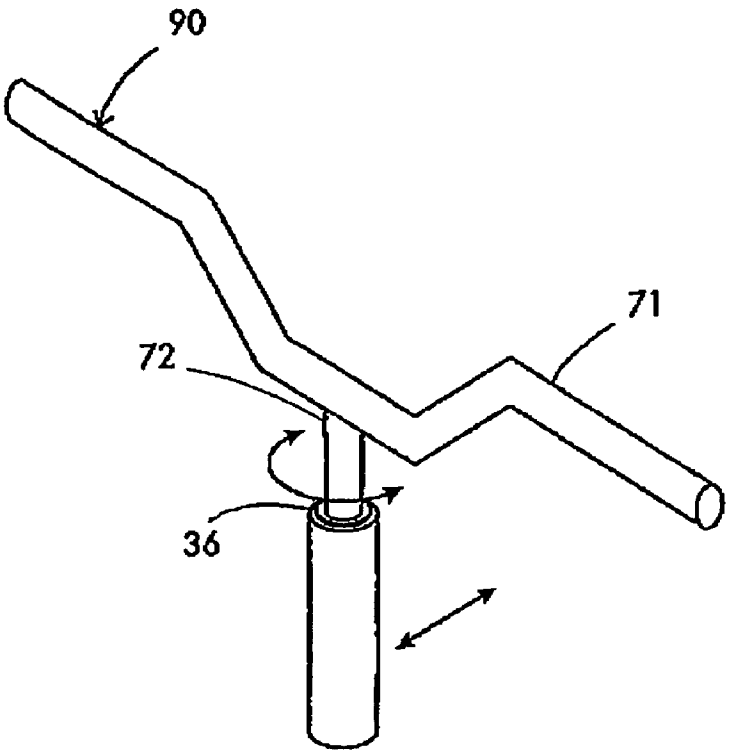
FIG. 2 shows an isometric view of steering mechanism 90 in the present invention.
Figure 5:
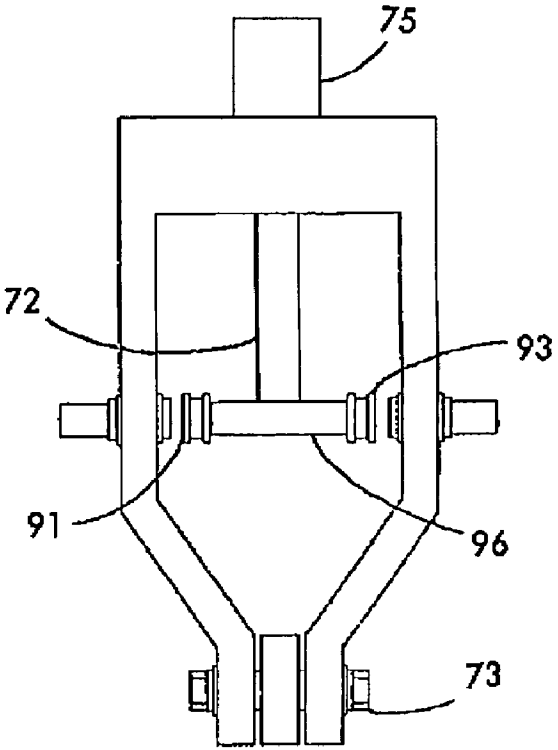
FIG. 5 is a front elevational view of a portion of propulsion mechanism 70 in the present invention.

Steering assembly 90, as seen in FIG. 1, is actuated by handle 71 when the latter rotates. As seen in FIG. 2, shaft 72 also rotates and the movement, at the other end, is transmitted to elongated linkage members 92 and 94. Linkage members 92 and 94 cross each other. Ends 91 and 93, of members 92 and 94, respectively, are pivotally mounted to horizontal rod 96 at spaced apart points. Ends 95 and 97 of members 92 and 94, respectively, are pivotally mounted to steering bar 98, as best seen in FIG. 3.

Figure 9:
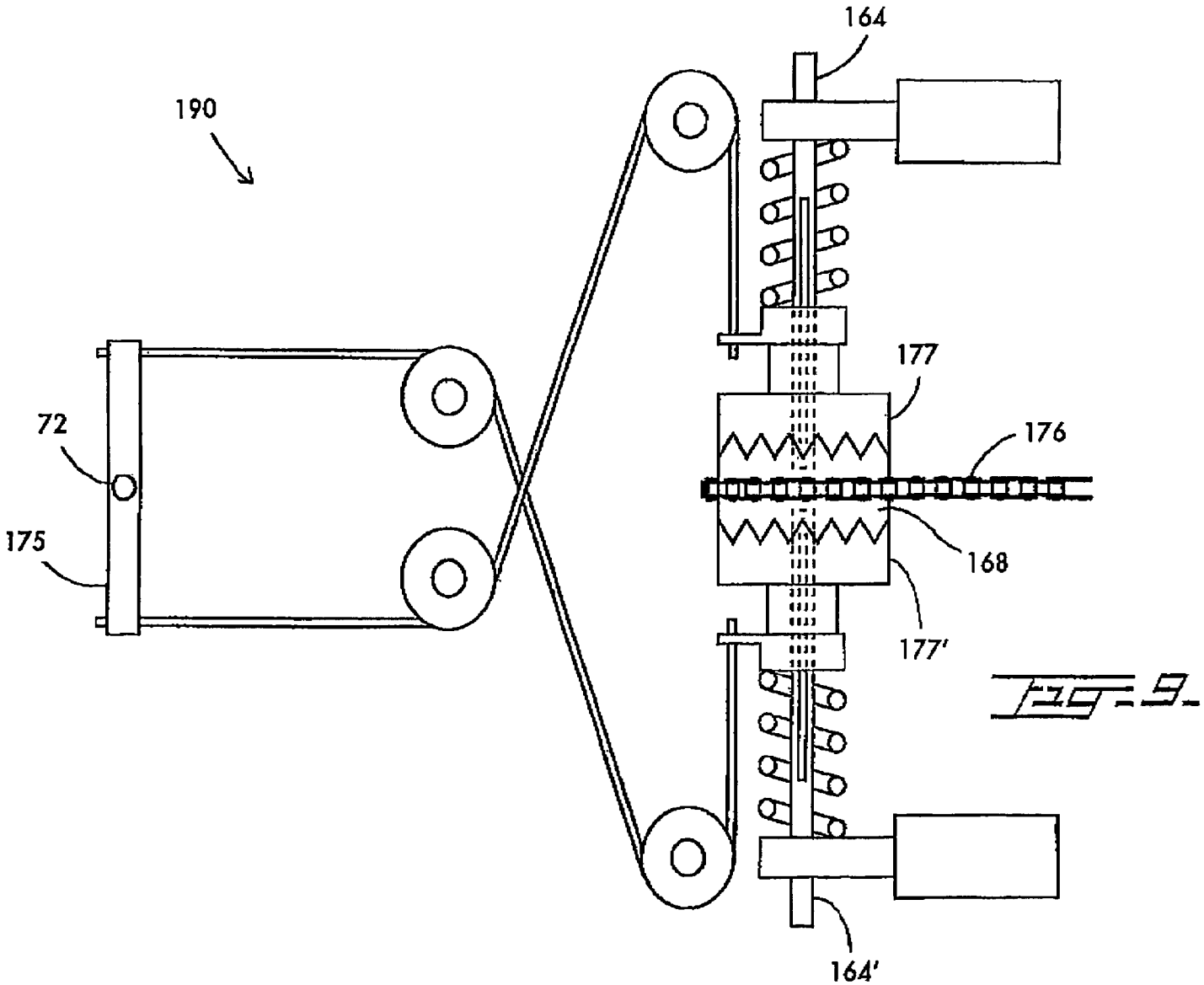
FIG. 9 shows a plan view of alternate steering assembly 190.
Figures 10, 10A:
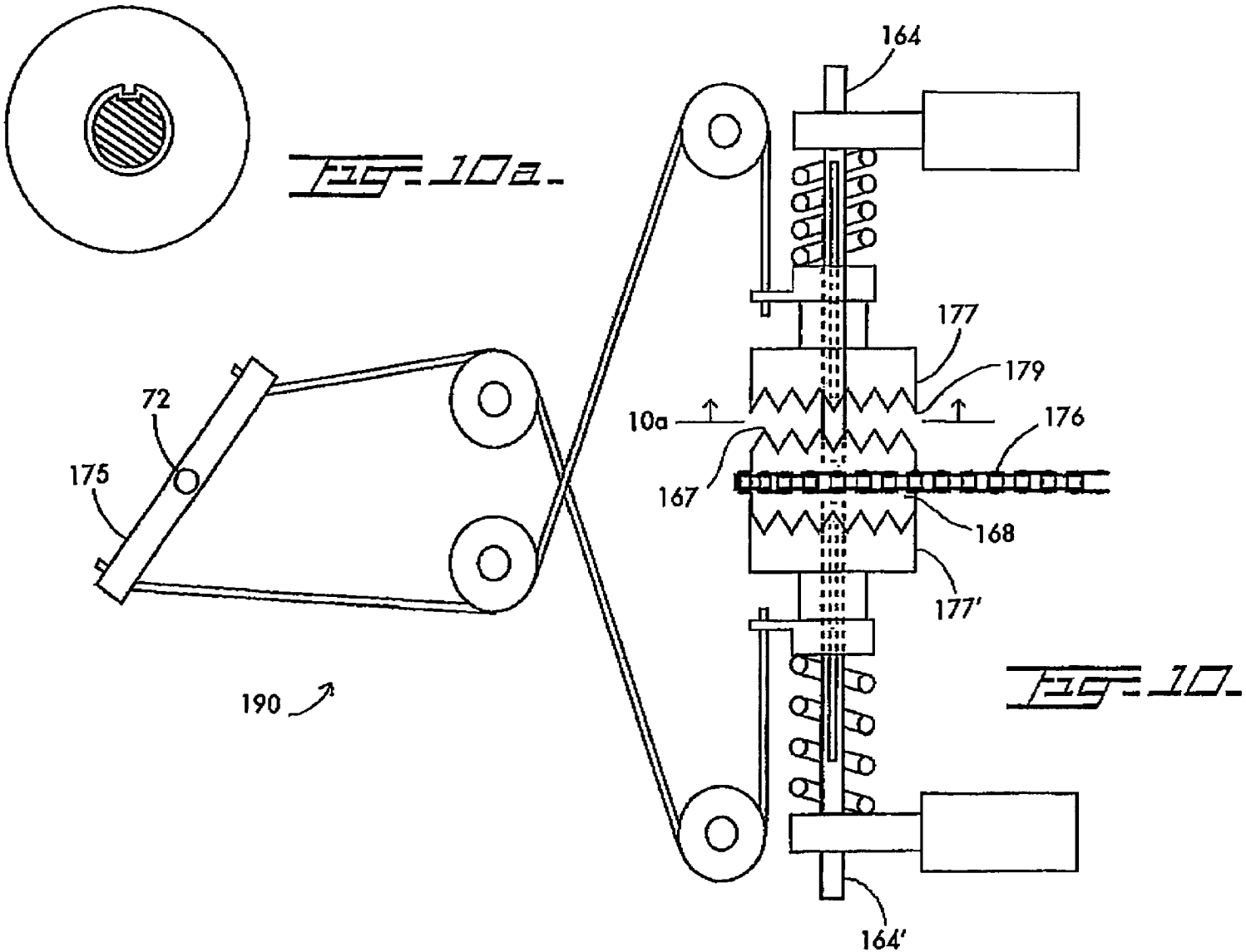
FIG. 10 is a similar representation of the alternate steering assembly shown in FIG. 9 with torque axle 75 at an angle.
FIG. 10*a* is an end view of clutch member 177 showing a keyed shaft in cross-section within the center.

Alternate steering mechanism 190 is shown in FIGS. 9 and 10. Freewheeling sprocket 168 is rotatably mounted axles 164 and 164'. Chain 176 is trained over sprocket 168 which transmit the movement of propulsion mechanism 70. This movement is selectively transmitted to either or both clutch members 177 and 177' with cooperating teeth 179 that engage with teeth 167. In this manner, when a user rotates torque axle 175, as shown in FIG. 10, one of the clutch members (177') disengages losing the rotational force delivered by sprocket 168 with the resulting veering of the machine in that direction. This steering mechanism is particularly useful in shallow bodies of water where a user benefits from a small draft.

The foregoing description conveys the best understanding of the objectives and advantages of the present invention. Different embodiments may be made of the inventive concept of this invention, including the placement of the paddle assemblies 160 and 160' in the rear, between the two floating assemblies 120 and 120', as shown in FIGS. 11 and 12, for alternate embodiment 100. It is to be understood that all matter disclosed herein is to be interpreted merely as illustrative, and not in a limiting sense.

What is claimed is:

1. A floating rowing machine to be used in a body of water comprising:

A) first and second elongated floating members each having front and rear ends, and first and second lateral sides;

B) frame means mounted to said first and second floating members;

C) a seat assembly mounted to said frame means;

D) paddle means having an axle rotatably mounted to said frame means and extending transversally across and beyond said floating members, said axle having first and second ends and a first sprocket member mounted to said axle at a predetermined position, and said paddle means further includes first and second paddle wheel assemblies rigidly mounted to said first and second ends and said first and second paddle wheel assemblies include a plurality of radially extending shafts each having a first distal end and further including a corresponding plurality of paddle members mounted thereon, respectively;

E) a propulsion mechanism that includes a bar pivotally mounted to said frame means, and further including a coaxially extending actuating frame assembly having a second distal end that moves reciprocally between two extreme positions, said propulsion mechanism further including first linkage member for transmitting said reciprocal movement having third and fourth ends, said third end being pivotally connected to said second distal end, and a second sprocket member rotatably mounted at a predetermined location on said frame means remote from said second distal end, said fourth end being pivotally mounted to an off-centered point on said second sprocket member so that said reciprocal movement is translated into a rotational movement of said second sprocket member, and further including a chain assembly trained over said first and second sprocket member to transmit said rotational movement from said second sprocket member to said first sprocket member, axle and paddle wheels; and F) means for steering said machine including a steering bar pivotally mounted to said frame means at a predetermined rear position, a rudder member mounted to said steering bar following its rotational movement and second linkage member connecting said steering bar to said rudder for steering said floating machine upon the actuation of said steering bar.

2. The machine set forth in claim 1 wherein said first and second paddle wheel assemblies each include a rim assembly connected to their respective paddle members to maintain the structural integrity of said paddle members when said machine is moved over a flat surface.

3. The machine set forth in claim 2 wherein said paddle members are mounted to said shafts at an angle of approximately between 30 and 50 degrees with respect to said axle.

4. The machine set forth in claim 3 wherein said paddle members are balanced with weights.

5. The machine set forth in claim 4 wherein each of said paddle members include at least one through opening so that the resistance to the water in said body of water is lowered.

6. A floating rowing machine to be used in a body of water comprising:

A) first and second elongated floating members each having front and rear ends, and first and second lateral sides;

B) frame means mounted to said first and second floating members;

C) a seat assembly mounted to said frame means;

D) paddle means having an axle rotatably mounted to said frame means and extending transversally across and beyond said floating members, said axle having first and second ends and a first sprocket member mounted to said axle at a predetermined position, and said paddle means further includes first and second paddle wheel assemblies rigidly mounted to said first and second ends and said first and second paddle wheel assemblies include a plurality of radially extending shafts each having a first distal end and further including a corresponding plurality of paddle members mounted thereon, respectively;

E) a propulsion mechanism that includes a bar pivotally mounted to said frame means, and further including a coaxially extending actuating frame assembly having a second distal end that moves reciprocally between two extreme positions, said propulsion mechanism further including first linkage member for transmitting said reciprocal movement having third and fourth ends, said third end being pivotally connected to said second distal end, and a second sprocket member rotatably mounted at a predetermined location on said frame means remote from said second distal end, said fourth end being pivotally mounted to an off-centered point on said second sprocket member so that said reciprocal movement is translated into a rotational movement of said second sprocket member, and further including a chain assembly trained over said first and second sprocket member to transmit said rotational movement from said second sprocket member to said first sprocket member, axle and paddle wheels; and F) steering assembly for steering said machine including clutch members for selectively engaging and disengaging the rotational movement applied to said first and second paddle wheel assemblies.

7. The machine set forth in claim 6 wherein said clutch members engage and disengage said first sprocket member.

8. The machine set forth in claim 7 wherein said first and second paddle wheel assemblies each include a rim assembly connected to their respective paddle members to maintain the structural integrity of said paddle members when said machine is moved over a flat surface.

9. The machine set forth in claim 8 wherein said paddle members are mounted to said shafts at an angle of approximately between 30 and 50 degrees with respect to said axle.

* * * * *